US010272005B2

(12) United States Patent
Heidingsfelder-Bongard et al.

(10) Patent No.: US 10,272,005 B2
(45) Date of Patent: Apr. 30, 2019

(54) BEDSIDE ASSISTANT AND ITS ATTACHMENT TO A BED

(71) Applicant: Brigitta Heidingsfelder-Bongard, Meschede (DE)

(72) Inventors: Brigitta Heidingsfelder-Bongard, Meschede (DE); Stephan Wüster, Okarben (DE)

( * ) Notice: Subject to any disclaimer, the term of this patent is extended or adjusted under 35 U.S.C. 154(b) by 362 days.

(21) Appl. No.: 15/136,666

(22) Filed: Apr. 22, 2016

(65) Prior Publication Data

US 2016/0310340 A1 Oct. 27, 2016

Related U.S. Application Data

(60) Provisional application No. 62/209,636, filed on Aug. 25, 2015.

(30) Foreign Application Priority Data

Apr. 24, 2015 (DE) ..... 20 2015 102 058 U

(51) Int. Cl.
*A61G 7/053* (2006.01)
*A47C 31/00* (2006.01)
(Continued)

(52) U.S. Cl.
CPC ..... *A61G 7/1038* (2013.01); *A47C 21/00* (2013.01); *A61G 7/053* (2013.01)

(58) Field of Classification Search
CPC ..... A47C 21/00; A47C 21/08; A47C 31/00; A61G 7/00; A61G 7/05; A61G 7/053; A61G 7/0533; A61G 7/0536; A61G 7/10; A61G 7/1038; A61G 7/1042; A61G 7/1044; A61G 7/1076; A61G 7/06
See application file for complete search history.

(56) References Cited

U.S. PATENT DOCUMENTS 2,981,959 A * 5/1961 Burnham ..... A61G 7/053 5/282.1
4,932,090 A * 6/1990 Johansson ..... A47K 17/024 5/662
(Continued)

FOREIGN PATENT DOCUMENTS

DE 29709508 U1 8/1997
DE 19716249 A1 11/1997
(Continued)

OTHER PUBLICATIONS

European Search Report dated Sep. 14, 2016 in related case DE 16166125.1.

*Primary Examiner* — Robert G Santos
*Assistant Examiner* — Rahib T Zaman
(74) *Attorney, Agent, or Firm* — Polson Intellectual Property Law P.C.; Margaret Polson; Christopher R. Sylvain

(57) ABSTRACT

A bedside assistant for a person in a bed comprising a vertical column that connects to the bed frame of a bed and an arm which is connected to the top of the vertical column. The arm can be rotated on the connection and swiveled with respect to the vertical column. The connection between the arm and the column comprises a locking mechanism locking one direction of the swivel movement of the arm and allowing a swivel movement of the arm in the other swivel direction.

12 Claims, 8 Drawing Sheets

(51) Int. Cl.
*A61G 7/10* (2006.01)
*A47C 21/00* (2006.01)

(56) References Cited

U.S. PATENT DOCUMENTS

| | | | | | |
|---|---|---|---|---|---|
| 6,039,293 | A * | 3/2000 | Minet | A61G 7/053 | 248/125.8 |
| 6,311,942 | B1 * | 11/2001 | Rotter | A61G 7/053 | 135/65 |
| 6,961,972 | B2 * | 11/2005 | Pendell | A47C 21/00 | 5/425 |
| 7,805,789 | B1 * | 10/2010 | Dean | A61G 7/053 | 5/646 |
| 2004/0181877 | A1 * | 9/2004 | Miller | A47C 21/00 | 5/622 |
| 2006/0130239 | A1 * | 6/2006 | Smith | A61G 7/053 | 5/662 |
| 2007/0044242 | A1 | 3/2007 | Banks | | |
| 2011/0079115 | A1 * | 4/2011 | Johnson | B25B 15/04 | 81/63.1 |

FOREIGN PATENT DOCUMENTS

| | | | |
|---|---|---|---|
| DE | 20307477 | U1 | 7/2003 |
| GB | 2420270 | A | 5/2006 |

* cited by examiner

BEDSIDE ASSISTANT AND ITS ATTACHMENT TO A BED

BACKGROUND

This invention describes a bedside assistant, which helps people sit up in bed and stand up from a bed, as well as the bed equipped with it.

For an injured or an elderly person, it is often difficult to get into an upright position or get out of bed from a horizontal position without help. Hospital beds usually have a movable horizontal bar extending around the bed from the headboard. Attached to the bar there is a triangular handle which assists a person lying in the bed to get into an upright position by grabbing the handle. But this kind of equipment does not help in the process of getting out of bed.

Other examples of bed mobility equipment are available, one example being DE 297 09 508 U1. This equipment contains a telescopic handle which can be removed and placed under the bed when not in use. When the handle is needed, it is taken out from beneath the bed and is opened vertically, slightly above the bed surface. The handle is stirrup-shaped and is swiveled on a vertical axis. The handle is fixed with a catch in a predetermined position. To release the catch and allow the handle to swivel it is necessary to lift the handle in a vertical direction in order to separate the lock. A person sitting on the edge of the bed can pull on the handle to help oneself stand out of bed. To use this mobility aid, however, it is necessary that a person is in a sitting position and the person's legs are preferably on the floor next to the bed.

Another example of bed mobility equipment is DE 203 07 477 U1. With this type of equipment, there is a handle mounted on a movable carriage under the bed. This device works similarly to DE 297 09 508 U1, helping a person get out of bed with a longitudinal displacement from the bed. Another is DE 197 16 249 A1, which is a height-adjustable handle that connects to the mattress support and can be attached to the bed frame. However, all this bed mobility equipment has the same drawbacks as DE 297 09 508 U1, mentioned in the previous paragraph.

In order for a person to both sit up in bed and stand up out of bed, two different mobility equipment devices are needed: one bar for sitting up and another mobility equipment device to get up. Metal bars fixed on beds as an aid for sitting up are widely used, but are mostly regarded as aesthetically displeasing.

The foregoing examples of the related art and limitations therewith are intended to be illustrative and not exclusive. Other limitations will become apparent to those of skill in the art upon a reading of the specification and a study of the drawings.

SUMMARY

The following embodiments and aspects thereof are described and illustrated in conjunction with systems, tool and methods which are meant to be illustrative, not limiting in scope. In various embodiments, one or more of the above described problems have been reduced or eliminated, while other embodiments are directed to other improvements.

Taking the existing bed mobility equipment as a baseline, the bedside assistant is a new concept aiding with complete bed mobility: not only does it help a person sit up from a vertical position, but also helps the person stand out of bed.

The bedside assistant comprises a vertical column which has an adjustable sleeve that enables mounting to the bed frame, and a metal arm for assistance in sitting up and standing out of bed, which extends from the top of the vertical column at a 90 degree angle when in use. The arm also may be swiveled. At the connection between the vertical column and the arm there is a locking mechanism. The locking mechanism enables the arm to be swiveled in one direction, whereas a swiveling movement in the opposite direction is locked.

The bedside assistant is attached to the frame of the bed. For example, it may be attached on a hospital or nursing bed which usually have metal frames and other parts suitable for mounting the bedside assistant's main vertical column. The bedside assistant comprises mounting equipment, a vertical column, an arm and an articulated part by means of which the arm can be connected to the vertical column. The vertical column may have a square cross-section for mounting onto the bed frame with an adjustable sleeve. The arm of the bedside assistant is connected to the top of the vertical column with a ratchet, which allows the arm to swivel in the horizontal plane. The arm is designed to extend over the width of the bed or at least over part of it. The ratchet, being the locking mechanism which enables the arm to be swiveled in the horizontal plain, allows such swiveling movement from a position crossing the bed into a position parallel to the long side of the bed. The arm can be swiveled outwards even further. Due to the ratchet locking mechanism, swiveling of the arm in the opposite direction is locked which therefore allows a person to use the arm to pull oneself in a sitting position. During the sitting up movement, the person may push the arm incrementally away from oneself and, due to the locking of the ratchet in the opposite direction, pull oneself further up in the sitting position. Once the person is sitting in the bed, the arm may be swiveled further outwards, helping the person to stand up out of bed. Also in this position, swivel movement of the arm is locked in the opposite direction due to the ratchet. When the person is sitting on the bedside with his or her feet on the floor, the person can stand up by using the arm as a support. When a person is fully standing, he or she can steady oneself by holding onto the arm's handle.

In many cases, one does not require the assistance of an aid for the reverse process whereby a person gets into the bed. However, if mechanical assistance is needed to get into bed, the bedside assistant may further be equipped with a releasable locking mechanism. In such an embodiment of the bedside assistant, the ratchet-like locking means are reversed as to their locking direction and the arm is moved in the same manner as when used as support for sitting up and standing up, expect that the locking means work in the other direction. Incrementally, one may unlock the locking mechanism and come from the sitting position into a laying position.

The bedside assistant is preferably equipped with an off-switch for the locking direction of the arm. This will be used to reverse direction of the arm locking mechanism according to the person's movement: either standing up or sitting down.

A ratchet or other mechanisms can be used to carry out the needed reversible locking process. Such a locking mechanism may use a ratchet brace and a tooth engagement system. In order to carry out that kind of ratchet brace mechanism, other kinds of mechanisms can be used.

The vertical column of the bedside assistant is designed as one or multiple parts. The vertical column connects to the bed frame. This vertical column can be hollow, so that a metal sleeve may be attached to the vertical columns allowing the column to slide along the length of the metal bed frame. If the vertical column consists of two parts, the second part of the vertical column connects to the arm. If the column consists of more than two parts, the arm is attached to the uppermost part of the vertical column.

The arm of the bedside assistant may have an asymmetrical right-angle curved hook shape, with the shorter end of the arm connected to the vertical column and the long side of the arm serving as the handle which a user holds on to when needed. The right-angle curve design of the arm provdies the added benefit that when the column is attached to the bed frame and near the bed surface is, the arm gives the space necessary for a person who, for example, is seated at the edge of the bed with his or her feet on the floor.

The arm may be comprised of two perpendicular parts: the shorter inside arm and the longer handle, which are joined by a curved 90-degree joint. The arm is connected to the top of the vertical column.

In one embodiment, the bedside assistant is designed so that the arm may be swiveled from a horizontal position to an upward vertical position, either for a useful position or a non-use holding position. In a non-use position, the arm can be used for other purposes, such as holding an infusion drip bag. For one angled arm, it is advantageous to allow for the swiveling motion to occur in the shorter end of the arm, rotating about its longitudinal axis. The arm can be placed into a vertical position by swiveling the short inside part of the arm along its own axis, thereby rotating the long handle side of the arm upwards in a vertical position. The inside portion of the arm can be designed to have a swivel pivot to allow for rotation along its own axis, along with a swivel pin to lock and unlock the swivel motion.

In addition to the aspects and embodiments described above, further aspects and embodiments will become apparent by reference to the accompanying drawings forming a part of this specification wherein like reference characters designate corresponding parts in the several views.

BRIEF DESCRIPTION OF THE DRAWINGS

The bedside assistant is shown in the following figures with its respective part numbers:

FIG. 1*a* gives an inner perspective and FIG. 1*b* gives an outside perspective.

DETAILED DESCRIPTION

Figure 1A:
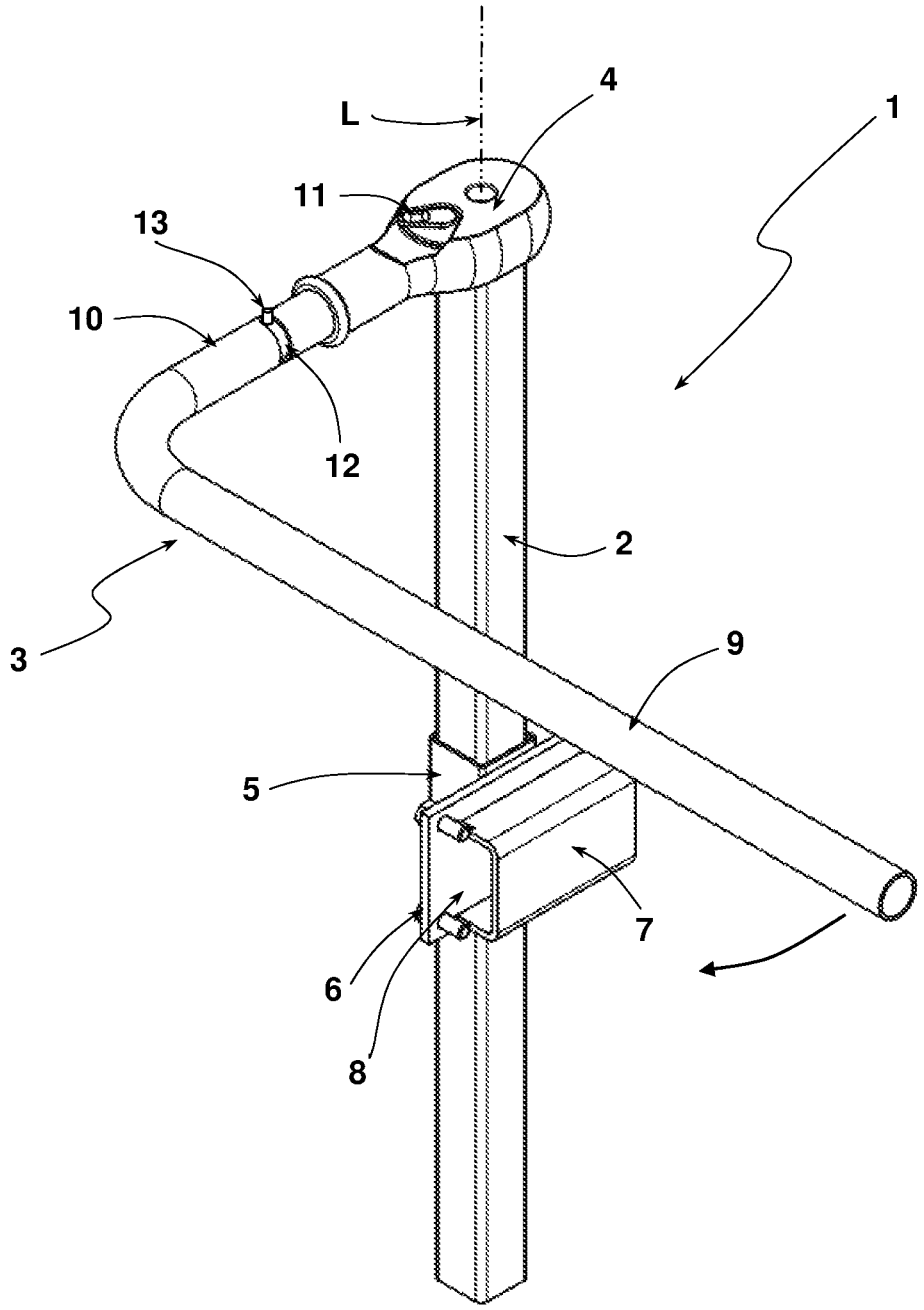
FIGS. 1*a*, 1*b*: a three-dimensional view of the bedside assistant complete from two perspectives.
Figure 1B:
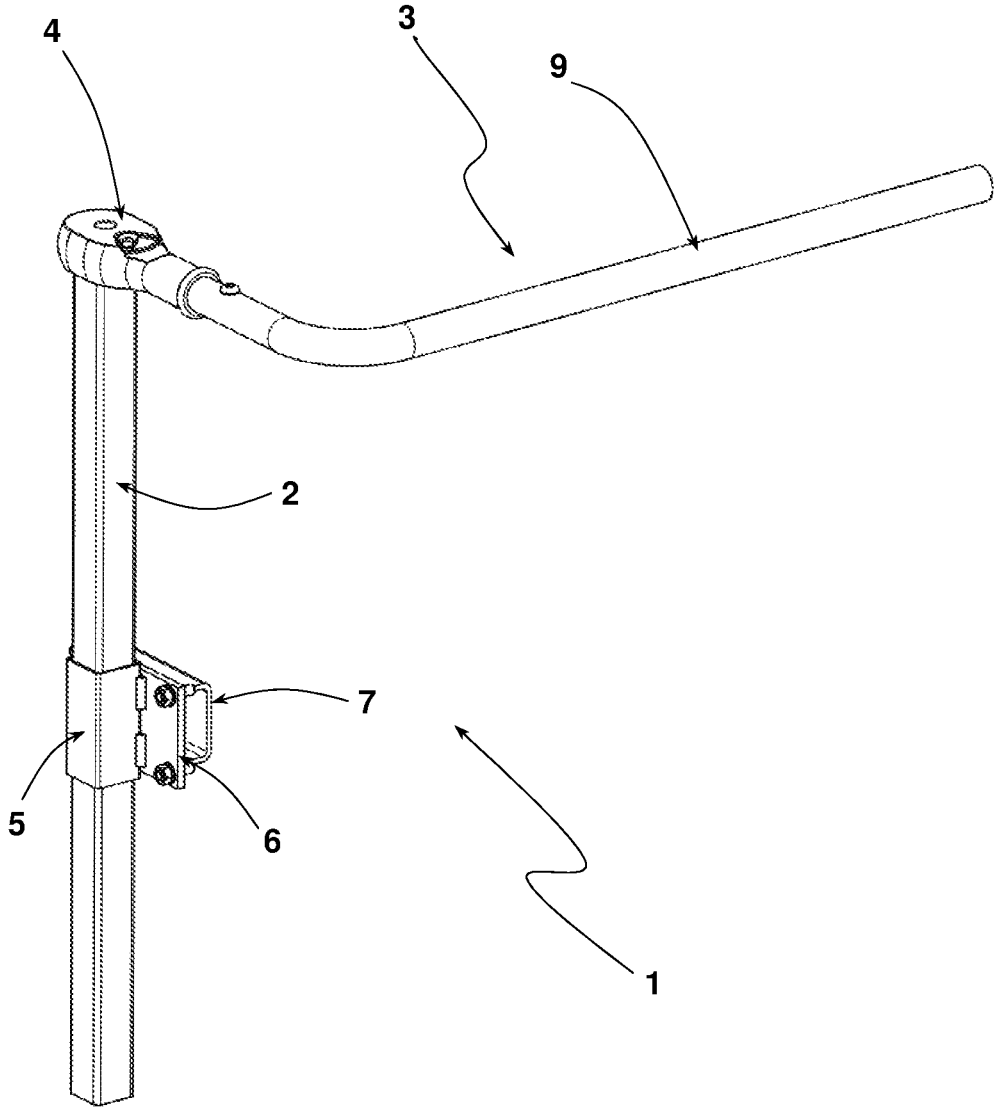

The bedside assistant 1 is made up of a vertical column 2 and an arm 3 which swivels on the vertical column 2. The arm 3 is attached to the vertical column 2 with a ratchet mechanism 4.

In one embodiment, the vertical column 2 is designed in one piece with a square cross section and rounded edges. Attached to the vertical column 2 is a vertical column sleeve 5. The vertical column sleeve 5 is a pipe with the same inner cross-sectional geometry as the outside geometry of the vertical column 2, such that the vertical column 2 slides into the vertical column sleeve 5. A clamp screw (not displayed) may be on the vertical column sleeve 5 such that the vertical column 2 is fixed onto the vertical column sleeve 5, and the height of the vertical column 2 may be adjusted. The bed frame sleeve 8 connects the bedside assistant 1 to the bed frame 14. The bed frame sleeve 8 is made up of the back of the sleeve 6 which mounts to the vertical column sleeve 5 and a U-shaped front bed frame sleeve 7 which slides onto the long side of the bed frame. The front bed frame sleeve 7 and back mounting bed frame sleeve 6 work to make a firm connection to the bed frame 14, such that the vertical column 2 is sturdily held in a vertical position alongside the bed frame 14.

The arm 3 may be curved at a right-degree angle, as shown in the embodiments of the drawings, so that an inside arm 10 and a handle 9 are formed. The long side of the arm 3 serves as a handle 9 that the user can hold and pull when he or she needs to get into an upright position in bed 15 or use for assistance in getting out of bed. The inside arm 10 is attached to the ratchet 4. The arm 3 rotates around the longitudinal axis L of the vertical column 2, as shown with an arrow in FIG. 1*a*.

The ratchet 4, which connects the arm 3 to the vertical column 2, contains a locking mechanism, which may be a latch similar to those seen in ratchet tools. As shown in FIG. 1*a*, the locking mechanism allows the arm 3 to swivel outwards in the direction shown by the left-pointing arrow, but does not allow direction in the opposite, inward direction. The direction of the ratchet's 4 locking mechanism can be changed by turning the ratchet directional switch 11. With this change-over mechanism, the arm 3 can be rotated in both directions, both outwards from the bed 15 and inwards toward the bed 15.

Figure 5:
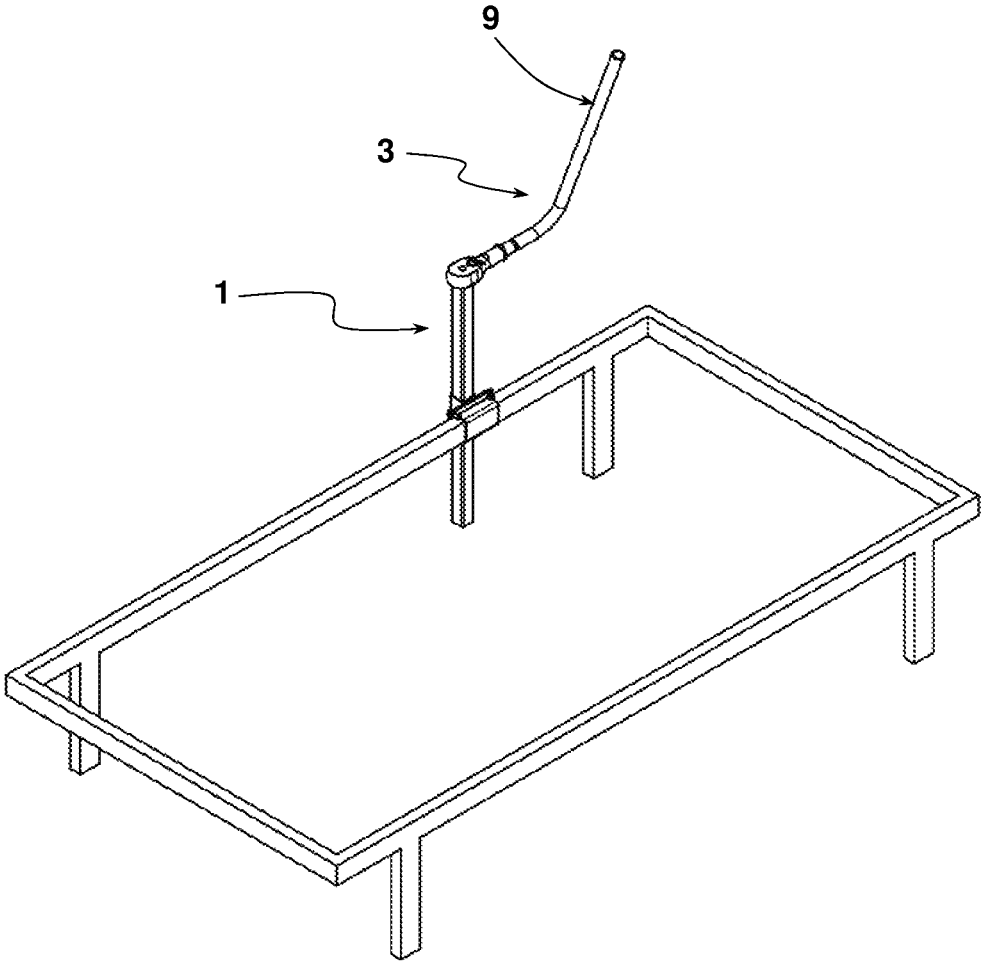
FIG. 5: a three-dimensional view of the bedside assistant attached to the bed frame and in an upward vertical position when not in use.

In addition to the arm's 3 rotation along a horizontal plane, the handle 9 may also rotate on a vertical plane, when the inside arm 10 is swiveled along its own axis. When swiveling the inside arm 10, the arm 3 is brought into an upright position as shown in FIG. 5. The upright position of the arm's handle 9 is ideal when the bedside assistant 1 is not in use. Moreover, the bedside assistant 1 can still be used for other purposes in such a vertical configuration, such as attaching an infusion drip bag.

On the inside arm 10, there is a slotted arm swivel guide 12. Inside, a swivel pin 13 is held engaged and thus the rotation of the arm 3 along the longitudinal axis L of the inside arm 10 is limited. In the arm 3 position shown in FIG. 1*a*, the swivel pin 13 is held on the edge of the slotted arm swivel 12, thus any lowering of the arm 3 in the direction of the bed 15 is prevented.

The bedside assistant 1 can, with its standing up aid, also be connected to another bedside. Depending on the orientation of the user of the bed, the standing up aid and/or the blocking mechanism may have to be adjusted accordingly.

Figure 2A:
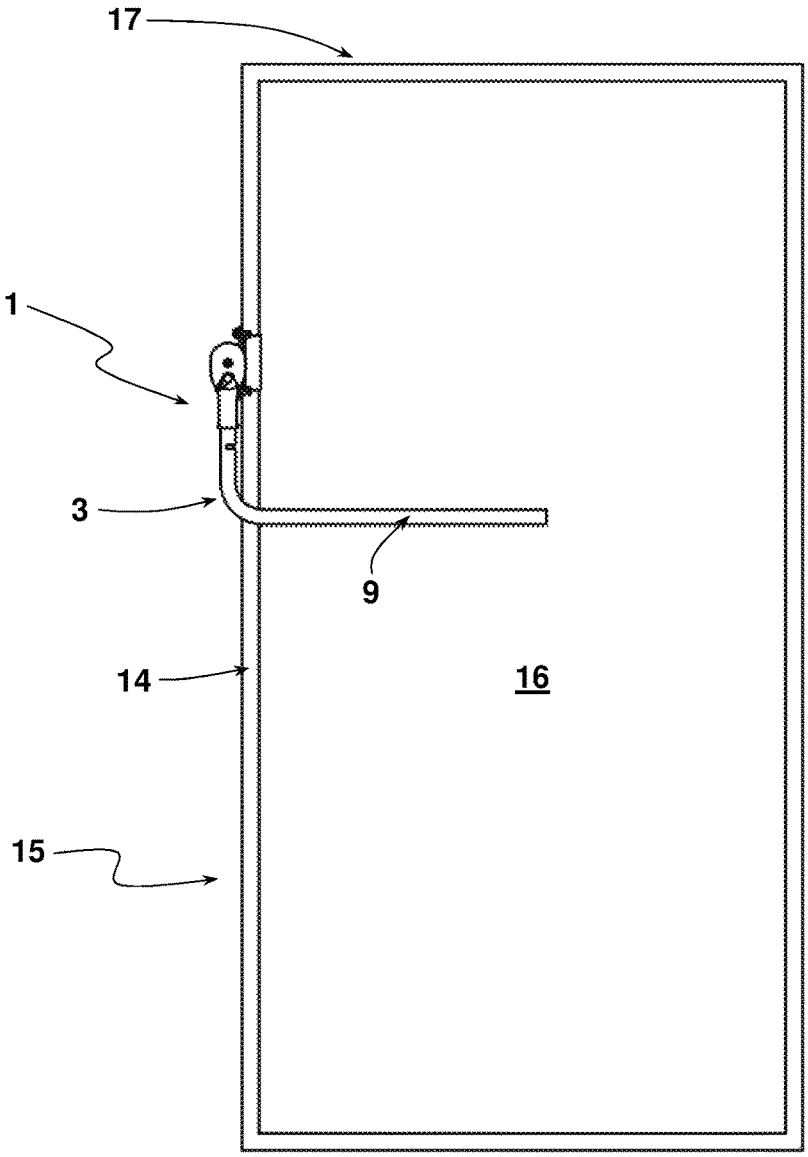
FIGS. 2*a*, 2*b*: a top view of the bedside assistant attached to a bed frame (FIG. 2*a*) and a three-dimensional view of the same setup (FIG. 2*b*)
Figure 2B:
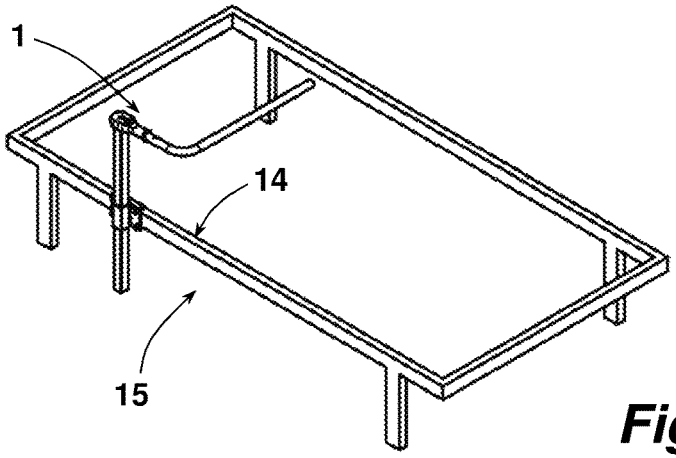

The bedside assistant 1 is attached to the bed frame 14 of the bed 15 as shown in FIGS. 2*a* and 2*b*. The bedside assistant 1 is attached to a longitudinal bar of the bed frame 14. The arm 3 extends over the bed surface 16. The position of the arm 3 in FIG. 2*b* is for a person lying vertically on the bed to grab the arm handle 9 in order to pull oneself up into a seated bed position. The arm 3 will be in the previously described locked position, keeping the handle 9 parallel to the bed's head frame 17 and locked parallel to the bed surface 16. Thus, a user can comfortably go back and forth in between lying and seated position by holding and pulling on the handle 9.

FIG. 2*b* shows how the variability in height of the vertical column 2 with respect to the bed frame 14 is especially important, considering the variability of thickness of the mattress, among other variables.

The user can also use the bedside assistant 1 to support himself in standing up from the bed 15. A person who has sat up from a horizontal position into a vertical position in bed then pushes the arm 3 towards the edge of the bed frame 14, which is possible due to the rotation of the ratchet 4.

Figure 3A:
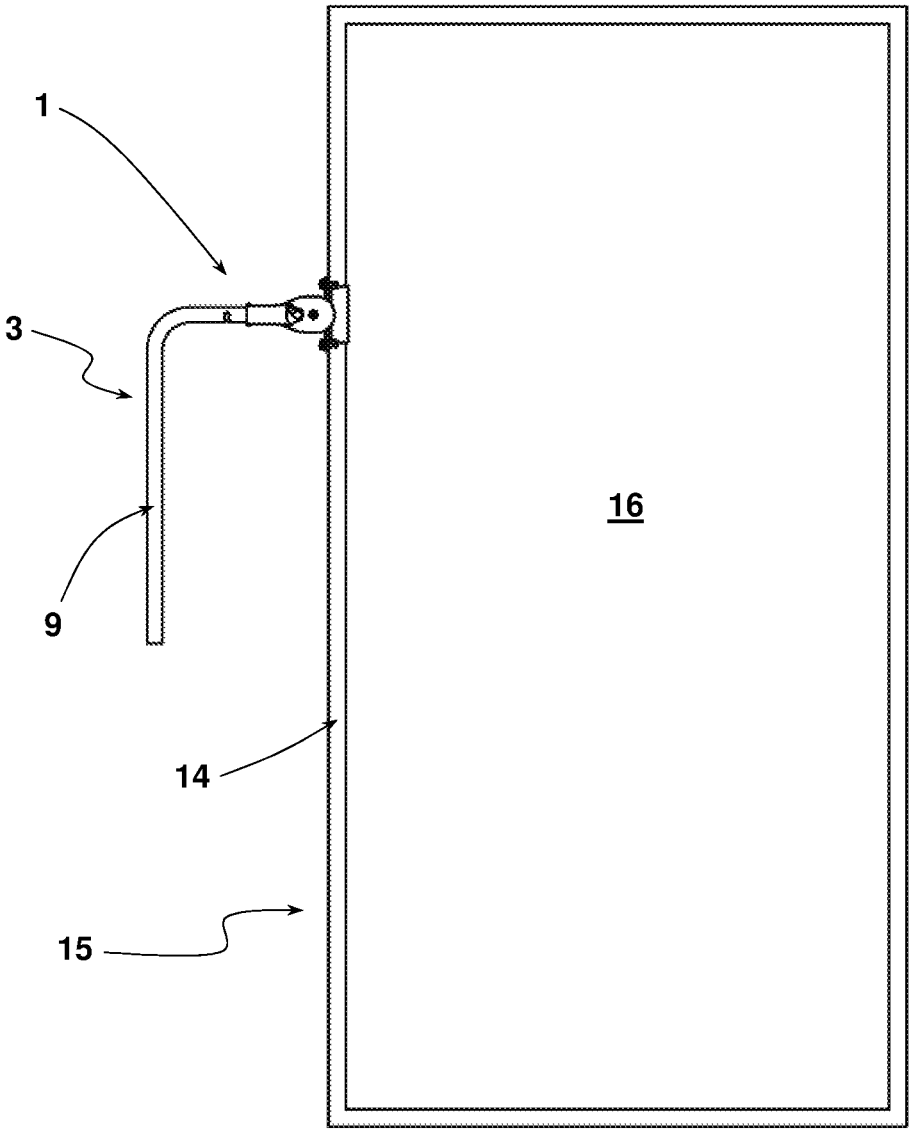
FIGS. 3*a*, 3*b*: a top view of the bedside assistant attached to a bed frame and in an open position (FIG. 3*a*) and a three-dimensional view of the same setup (FIG. 3*b*)
Figure 3B:
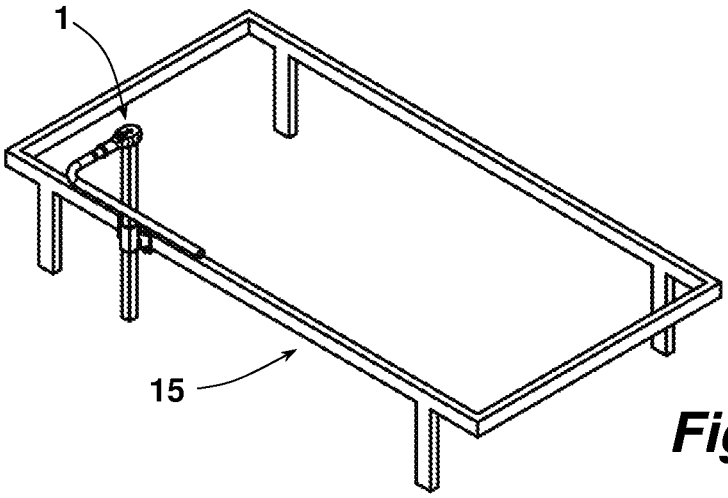

FIGS. 3*a* and 3*b* show a position of the bedside assistant 1 corresponding to when a user is sitting at the edge of the bed 15 and his or her feet are on the floor. In this position, the arm 9 provides support for the use, while the extension of the angled inside arm 10 gives enough space for the person on the side of the bed 15. In this position, a user can use the handle 9 to pull himself up from a sitting to a standing position without other assistance.

Figure 4:
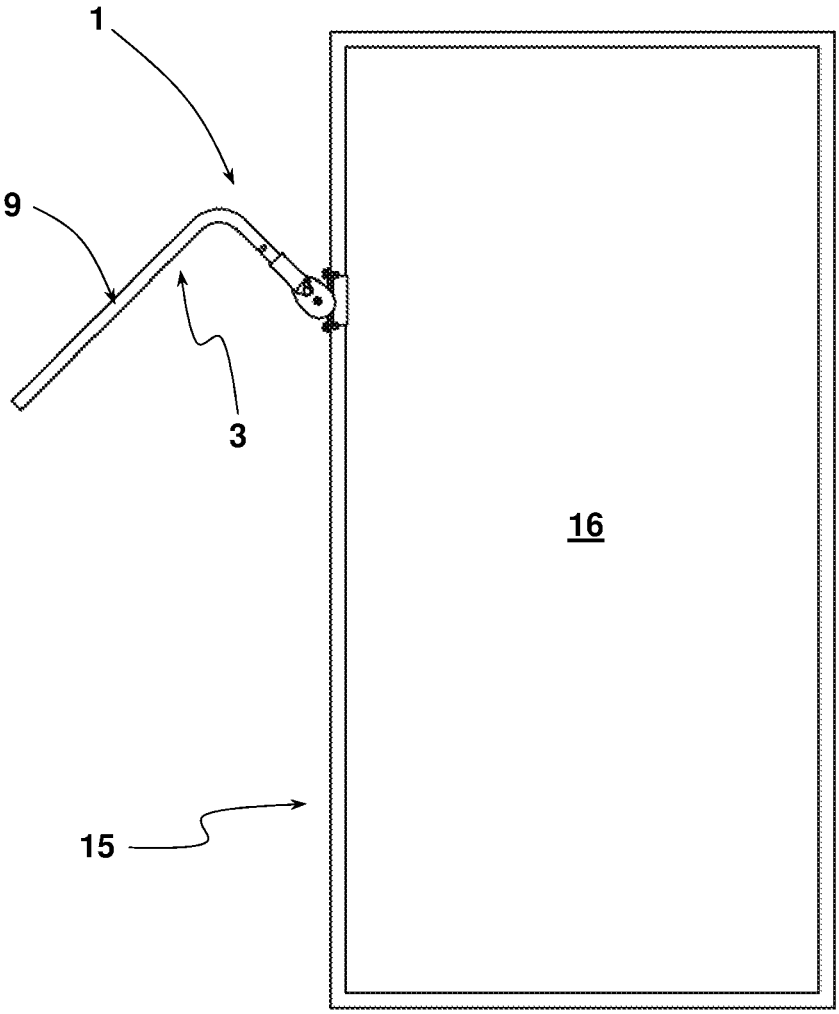
FIG. 4: a top view of the bedside assistant attached to the bed frame and in a further open position.

In order to make it easier to stand up from bed 15 for some users, FIG. 4 shows how the arm 3 can be swiveled even further outward from the bed frame 14. In this manner, a user is given even more room while holding the handle 9 for support in standing up.

While FIGS. 1*a* to 4 show different variations on the use of the bedside assistant 1 in assisting a person's mobility in bed 15, FIG. 5 shows the bedside assistant 1 in an unused position, in which the handle 9 can be used for other purposes, such as hanging an infusion drip bag. FIG. 5 shows one desired position of the bedside assistant 1 when not needed for assisting a person's mobility in and out of bed 15.

When the bedside assistant's 1 arm 3 crosses the bed 15, as in FIGS. 2*a* and 2*b*, it may also be used for non-mobility purposes, such as supporting a laptop holder, or attaching table tops for food.

The bedside assistant 1 has been shown in the drawings as attached to the right side of the bed 15. However, the bedside assistant 1 may be mounted to either side of the bed, as desired by the user, in embodiments having symmetrical designs.

Figure 6:
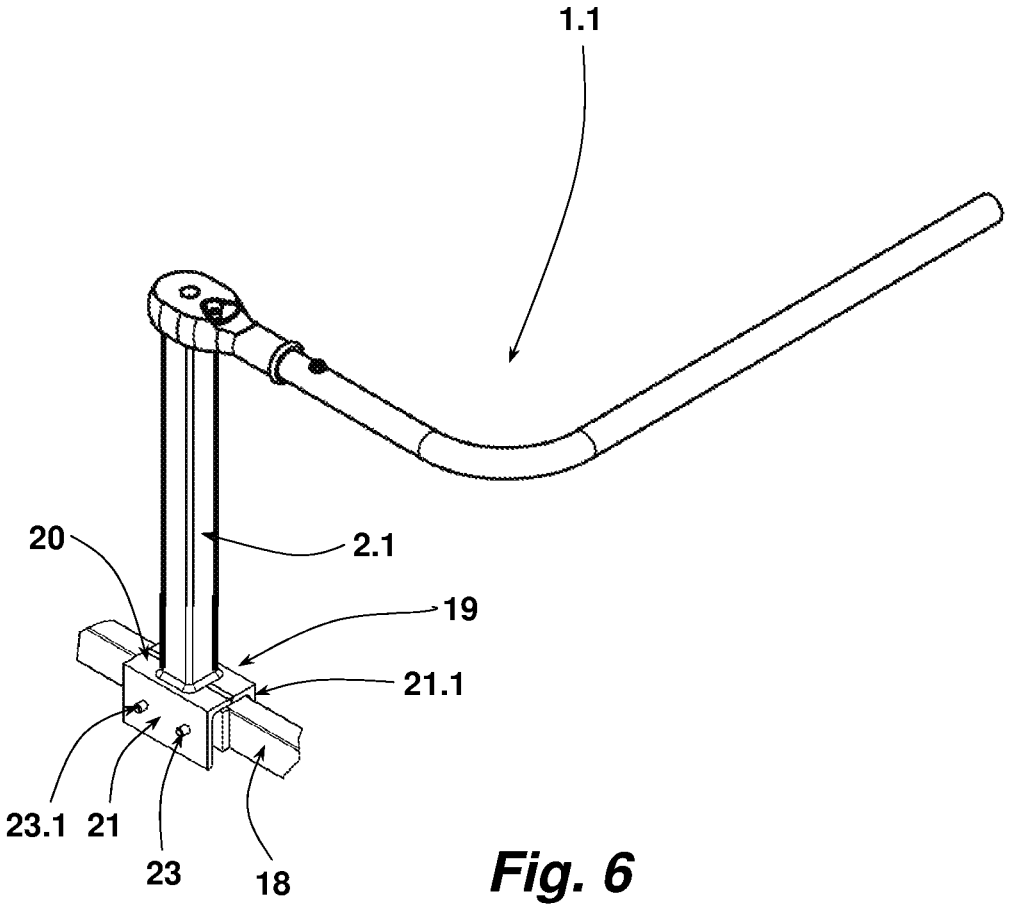
FIG. 6: a perspective view of a Bedside Assistant, in principle designed the same as that of the preceding figures, which Bedside Assistant is connected to the frame part of a bed frame using another connection means.
Figure 7:
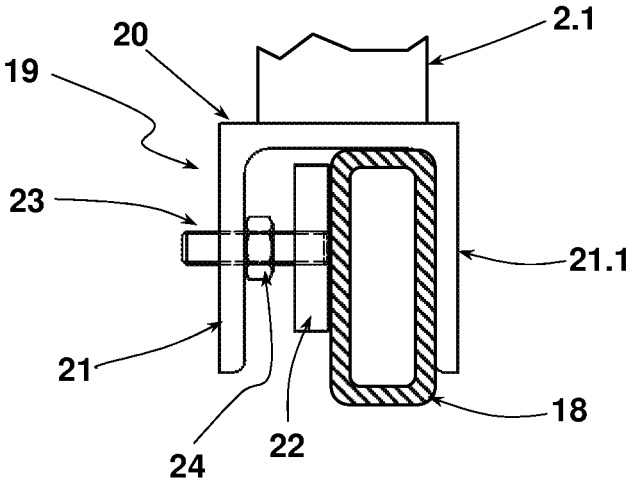
FIG. 7: a front lateral view of the connection means of FIG. 6, and FIG. 8: a top view of a further connection means for connecting to a Bedside Assistant to a bed frame in a top view.

The bedside assistant 1.1 shown in FIG. 6 comprises another embodiment which corresponds the bedside assistant 1 of the preceding figures. The bedside assistant 1.1 differs with regard to its connection means for connecting the column 2.1 to the bar 18 of a bed frame (not shown in more detail here). In the bedside assistant 1 of the preceding figures, a sleeve for connecting the bedside assistant 1 to a bed frame was used as the connection means. On the other hand, the connection means of the bedside assistant 1.1 is implemented as a clamping socket 19. The clamping socket 19 has a U-shaped bar receptacle 20, the two legs 21, 21.1 of which are directed away from the column 2.1 of the bedside assistant 1.1. Thus, the bar support 20 is opened downwards and is placed on the bar 18 from the top. The column 2.1 of the bedside assistant 1.1 is located at the back of the U-shaped bar receptacle 20. The bar receptacle 20 and the column 2.1 are welded together. For fixing the clamping socket 19 to the bar 18, a clamping plate 22 is provided within the bar receptacle 20 with a planar extension parallel to the legs 21, 21.1. Two clamping screws 23, 23.1 engage through the leg 21 of the bar receptacle 20, and this engagement is used as a guide for the clamping screws 23, 23.1. On the clamping screws 23, 23.1, as shown in FIG. 7, a clamping nut 24 is placed for clamping the clamping plate 22 on the bar 18 against the inside of the leg 21. The clamping connection between the bar 18 and the leg 21.1 of the bar receptacle 20 and the clamping plate 22 is effected by clamping the clamping nut 24.

The bar receptacle 20 is suitable for connecting to differently designed bed frames or the longitudinal bars thereof, because the bedside assistant 1.1 with its bar receptacle 20 as the connection means is placed from the top onto a longitudinal bar. When using a clamping socket 19, it is therefore not required to grab around the longitudinal bar, as provided for in the bedside assistant 1 with a sleeve comprising a bar. The clamping socket 19 may have a certain longitudinal extension, as a result of which an introduction of force by a larger surface is introduced into the bar received therein. The bedside assistant 1.1, attached via the column 2.1 to the bar receptacle 20 of the clamping socket 19, then has no substantial torsional forces acting on it during use. The clamping socket 19 can also be used, without having to accept damage to weight-optimised bars, for connecting a bedside assistant to a bed frame.

Figure 8:
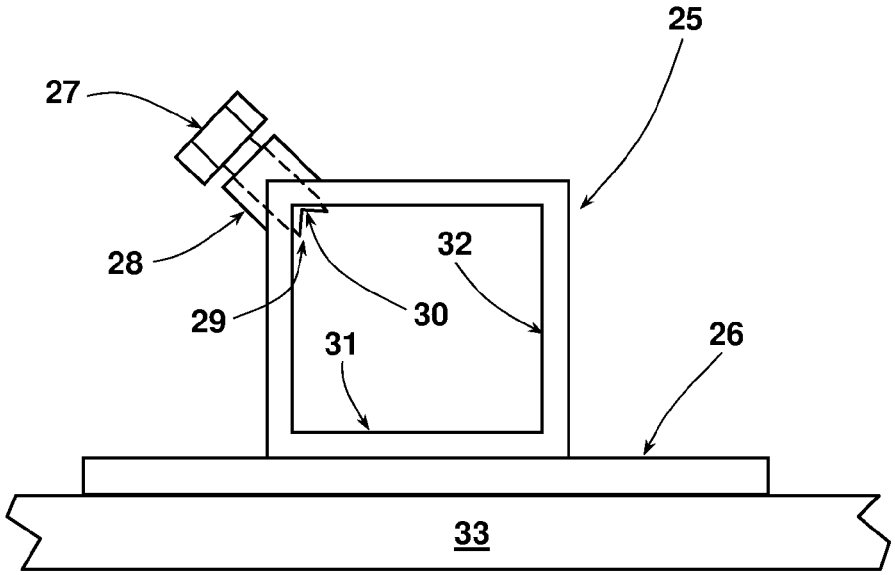

FIG. 8 shows a top view, in diagrammatic form, of a further embodiment for attaching a bedside assistant to a bed frame by means of the column. As shown in FIG. 8, for connecting the column to a frame part of a bed, the connection means is a column receptacle 25 which is fixed by means of a fixture plate 26 on the side of a bar of a bed frame that faces outwards. This may be carried out using screws or through an assembly process. The column receptacle 25 is shown in FIG. 8 from a top view. This column receptacle 25 is a square tube section having an internal width, into which the column of a bedside assistant can be placed. The inner width of the column receptacle 25 is configured to the edge length of a column of a bedside assistant equally including a square cross-sectional area. A clamping screw 27 may be used for fixing the column within the column receptacle 25. The clamping screw 27 engages its threaded shaft in a threaded sleeve 28 having a complementary internal thread. The internal thread 28 is provided at an edge of the column shaft 25, and the axis of the internal thread bore of the threaded sleeve 28 extends in alignment with the angle bisector of the walls of the column receptacle that are adjacent to each other along the edge. As a result, the foot 29 of the clamping screw 27, which in the embodiment shown is equipped with a rectangular notch 30, acts on an edge of a column placed in the column receptacle 25. The column placed in the column receptacle 25 is therefore pressed against the inside of the walls 31, 32 by the clamping screw 27. In this way, a column of a bedside assistant, which is placed in the column receptacle 25, is fixed in both directions of the opening of the column receptacle 25. If such a connection means is used, the height of the bedside assistant can be adjusted in the same way as with the bedside assistant 1.

Any transverse forces occurring during the use of the bedside assistant are introduced via the length of the fixture plate 26 in an extensive manner in the adjacent bar 33.

While a number of aspects and embodiments have been discussed above, those of skill in the art will recognize certain modifications, permutations, additions and sub-combinations therefore. It is therefore intended that the following appended claims hereinafter introduced are interpreted to include all such modifications, permutations, additions and sub-combinations are within their true spirit and scope. Each apparatus embodiment described herein has numerous equivalents.

The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed. Thus, it should be understood that although the present invention has been specifically disclosed by embodiments and optional features, modification and variation of the concepts herein disclosed may be resorted to by those skilled in the art, and that such modifications and variations are considered to be within the scope of this invention as defined by the appended claims.

In general the terms and phrases used herein have their art-recognized meaning, which can be found by reference to standard texts, journal references and contexts known to those skilled in the art. The above definitions are provided to clarify their specific use in the context of the invention.

PART NUMBERS OF THE BEDSIDE ASSISTANT AS SEEN ON THE FIGURES

1, 1.1 Bedside Assistant
2, 2.1 Vertical Column
3 Bedside Arm
4 Ratchet
5 Vertical Column Sleeve
6 Back of Bed Frame Sleeve
7 Front of Bed Frame Sleeve
8 Bed Frame Sleeve
9 Handle
10 Inside Arm
11 Ratchet Direction Switch
12 Slotted Arm Swivel
13 Swivel Pin
14 Bed Frame
15 Bed
16 Bed Surface
17 Head Frame
18 Bar
19 Clamping Socket
20 Bar Receptacle
21, 21.1 Leg
22 Clamping Plate
23, 23.1 Clamping Screw
24 Clamping Nut
25 Column Receptacle
26 Fixture plate
27 Clamping Screw
28 Threaded Sleeve
29 Foot
30 Notch
31 Inner Wall
32 Inner Wall
33 Bar
L Longitudinal Axis

The invention claimed is:

1. A bedside assistant for a person in a bed comprising:

a vertical column configured to connect to a bed frame of the bed; and an arm coupled to the vertical column at a connection, the arm being angled asymmetrically to form a shorter end being the inside arm and a longer end, with the shorter end connected to the vertical column and the longer end serving as a handle, the handle extending over a surface of the bed when the inside arm is parallel to an edge of the bed, the handle configured to rotate at the connection and swivel about the vertical column in the horizontal plane;

wherein the connection between the arm and the vertical column comprises a locking mechanism, the locking mechanism preventing swivel movement of the arm in a first direction and allowing swivel movement of the arm in a second direction opposite the first direction;

wherein from a position of the user in the bed using the bedside assistant to sit or stand up, the locking mechanism can allow swivel movement of the arm in a pushing direction and prevent swivel movement of the arm in a pulling direction.

2. The bedside assistant of claim 1, wherein the locking mechanism can be switched in order to change the direction in which the arm is locked from swivel movement.

3. The bedside assistant of claim 1, wherein the locking mechanism is a ratchet mechanism.

4. The bedside assistant of claim 1, wherein the arm is bow-shaped.

5. The bedside assistant of claim 1, wherein the arm can be swiveled to a non-use position when the arm is in a horizontal position.

6. The bedside assistant of claim 1, wherein the arm is configured to adjust between a use position and a non-use position by rotating the inside arm along its own axis.

7. The bedside assistant of claim 1, wherein the arm is connected to the vertical column with a ratchet, the handle may be rotated around an axis of the inside arm by pressing a button on the inside arm, the button unlocking a swivel pin, and with rotational movement of the inside arm relative to the axis of the inside arm limited by a guide groove of a slotted arm swivel.

8. The bedside assistant of claim 1, wherein the vertical column is connected to the bed frame of the bed by a bed frame sleeve which surrounds the bed frame.

9. The bedside assistant of claim 1, wherein the vertical column is connected to a frame part of the bed by a connecting means, the connecting means comprising a clamping socket having an open bar receptacle facing away from the vertical column, in which bar receptacle a tensible clamping plate is adjustably provided.

10. The bedside assistant of claim 9, wherein the bar receptacle is U-shaped and the vertical column is connected to the back of the U-shaped bar receptacle.

11. The bedside assistant of claim 1, wherein the vertical column is connected to a frame part of the bed by a connection means, the connecting means comprising a column receptacle attachable to the outside of the frame part and having a multi-angular opening for receiving the vertical column, the vertical column also formed to be multi-angular, wherein the column receptacle has tensioning means for exerting a clamping force acting on at least two inner walls on the vertical column when inserted therein.

12. The bedside assistant of claim 1, wherein the bed is a hospital or nursing bed.

* * * * *